US006852015B2

(12) United States Patent
Ito et al.

(10) Patent No.: US 6,852,015 B2
(45) Date of Patent: Feb. 8, 2005

(54) METHOD AND APPARATUS FOR GRINDING WORKPIECE SURFACES TO SUPER-FINISH SURFACE WITH MICRO OIL POCKETS

(75) Inventors: Naoki Ito, Handa (JP); Mamoru Katsuta, Kariya (JP); Shinji Soma, Handa (JP); Kazuhisa Sugiyama, Okazaki (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/254,512

(22) Filed: Sep. 26, 2002

(65) Prior Publication Data

US 2003/0139120 A1 Jul. 24, 2003

(30) Foreign Application Priority Data

Sep. 27, 2001 (JP) ..... 2001-297919

(51) Int. Cl.[7] ..... B24B 5/04
(52) U.S. Cl. ..... 451/49; 451/72
(58) Field of Search ..... 451/62, 49, 56, 451/57, 58, 72, 8, 10

(56) References Cited

U.S. PATENT DOCUMENTS 2,577,818 A * 12/1951 Shaw ..... 451/51
4,073,281 A 2/1978 Asaeda et al.
4,293,913 A * 10/1981 Nishimura et al. ..... 451/10
5,456,538 A * 10/1995 Honda et al. ..... 384/569
5,562,523 A * 10/1996 Asano et al. ..... 451/1
5,643,054 A * 7/1997 Bach et al. ..... 451/49
6,409,573 B1 * 6/2002 Mukai et al. ..... 451/5

FOREIGN PATENT DOCUMENTS

| | | |
|---|---|---|
| DE | 197 14 677 | 10/1998 |
| EP | 0 990 483 | 4/2000 |
| EP | 1 044 764 | 10/2000 |
| JP | 2000-127038 | 5/2000 |
| JP | 2000-263397 | 9/2000 |

* cited by examiner

*Primary Examiner*—Robert A. Rose
(74) *Attorney, Agent, or Firm*—Oblon, Spivak, McClelland, Maier & Neustadt, P.C.

(57) ABSTRACT

A grinding machine rotatably carrying a finish grinding wheel and a super-finish grinding wheel respectively on first and second wheel heads practices a method of grinding workpiece surfaces to super-finish surfaces with micro oil pockets. A surface of a workpiece rotatably carried on the machine is first ground with the finish grinding wheel to a predetermined diameter under the control of a sizing device. The workpiece surface is then ground with the super-finish grinding wheel to a target diameter under the control of a sizing device. The super-finish grinding is performed to the extent that peaks of a section curve representing the roughness of the workpiece surface attained by the finish grinding are removed but bottoms of the surface curve are left to a depth when the target diameter is reached, so that the bottoms so left of the roughness constitute the micro oil pockets.

3 Claims, 5 Drawing Sheets

METHOD AND APPARATUS FOR GRINDING WORKPIECE SURFACES TO SUPER-FINISH SURFACE WITH MICRO OIL POCKETS

INCORPORATION BY REFERENCE

The present application claims priority under 35 U.S.C. .sctn.119 to Japanese Patent Application No. 2001-297919, filed on Sep. 27, 2001. The contents of that application are incorporated herein by reference in its entirety.

BACKGROUND OF THE INVENTION

1. Field of the Invention

The present invention relates to methods and apparatus for grinding a surface of a workpiece to a super-finish surface with micro oil pockets by grinding the workpiece surface with a super-finish grinding wheel after a finish grinding with a finish grinding wheel.

2. Description of the Related Art

Heretofore, crankpins and journals of crankshafts have been ground with a finish grinding wheel on a grinding machine and then, have been lapped on a lapping machine for improved surface roughness. The surfaces of the crankpins and journals after the lapping process have a roughness of the order which ranges from 0.4 through 0.8 $\mu$mRzISO. As shown in FIG. 1, the section curve representing the roughness in an exaggerated scale shows that the lapped surface is shallow and uniform in the height of irregularity and that there hardly exist micro oil pockets. Due to lack of micro oil pockets, such lapped surfaces of the crankpins and journals are liable to suffer from seizure to bearing members therefor.

To obviate this drawback, it is desirable that the crankpins and journals be ground so that as shown in FIG. 2, the section curve representing the surface roughness thereof has the irregularity which is uniform in the height of peaks and roughly uniform in the depth of bottoms, but which disperses deep bottoms here and there to provide micro oil pockets. Further, since the crankpins and journals are ground on a grinding machine and then, are lapped on a lapping machine, a longer machining time as well as a higher cost for the machining facilities are disadvantageously unavoidable.

SUMMARY OF THE INVENTION

It is therefore a primary object of the present invention to provide methods and apparatus capable of forming micro oil pockets on a workpiece surface in a super-finish grinding.

Briefly, there is provided a method of grinding a surface of a workpiece to a super-finish surface with micro oil pockets. The method comprises a step of performing a finish grinding on a rotating workpiece with a finish grinding wheel to a predetermined size; and a step of performing a super-finish grinding on the finish surface of the workpiece with a super-finish grinding wheel. The super-finish grinding is performed to the extent that bottoms of a section curve representing the surface roughness of the finish surface are left to a depth for the micro oil pockets.

In another aspect of the present invention, there is provided a method of grinding a surface of a workpiece to a super-finish surface with micro oil pockets. The method comprises a step of performing a finish grinding on a rotating workpiece with a finish grinding wheel to a predetermined size; and a step of, while measuring the diameter of the finish surface, performing a super-finish grinding on the finish surface of the workpiece with a super-finish grinding wheel. The super-finish grinding is performed to the extent that bottoms of a section curve representing the surface roughness of the finish surface are left to a depth for the micro oil pockets.

In still another aspect of the present invention, there is provided a method of grinding a surface of a workpiece to a super-finish surface with micro oil pockets. The method comprises a step of a finish grinding on a rotating workpiece with a finish grinding wheel to a predetermined size; a step of measuring the finish surface of the workpiece by a sizing device; and a step of, while measuring the diameter of the finish surface, performing a super-finish grinding on the finish surface with a super-finish grinding wheel. The super-finish grinding is performed until the sizing device detects that the diameter of the workpiece is decreased by the dimension which coincides with approximately the surface roughness of the finish surface.

In a further aspect of the present invention, there is provided an apparatus for grinding a surface of a workpiece to a super-finish surface with micro oil pockets. The apparatus comprises a bed; a workpiece support device mounted on the bed for rotatably supporting the workpiece to be ground about a rotational axis; first and second wheel heads mounted on the bed to be movable relative to each other in a direction parallel with the rotational axis and to be movable independently of each other toward and away from said workpiece; a finish grinding wheel and a super-finish grinding wheel rotatably mounted respectively on the first and second wheel heads; and feed devices controllable by a numerical controller for respectively moving the first and second wheel heads independently of each other in a first direction parallel to the rotational axis as well as in a second direction across the rotational axis. The apparatus further comprises a sizing device for measuring the diameter of the workpiece to transmit the measured diameter to the numerical controller. The numerical controller includes means for practicing the method as set forth in claim 1 or 2 of grinding a surface of the workpiece to a super-finish surface with micro oil pockets.

With the method and apparatus according to the present invention, forming the micro oil pockets on the super-finish surface of the workpiece is attained by the combination of a finish grinding and a super-finish grinding. Therefore, the super-finish surface of the workpiece is given a high quality of surface roughness wherein micro oil pockets are formed on a smooth surface finished up with a super-finish grinding wheel. When the workpiece machined by the method according to the present invention is assembled in a bearing member, the micro oil pockets on the workpiece surface serves to retain lubricating oil and to supply the oil to the friction area between the workpiece and the bearing member. Thus, the workpiece given the micro oil pockets according to the present invention assures the bearing assembly a high degree of rotational accuracy as well as a longer life of use. Further, a lapping process on a lapping machine is no longer essential, so that the workpiece can be finished in a shorter machining time and at a lower machining cost.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

Figure 1:
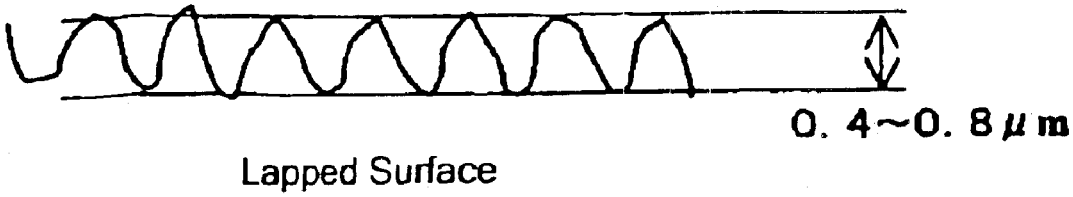
PRIOR ART FIG.1
FIG. 1 is a section curve representing the roughness of a lapped surface.
Figure 2:
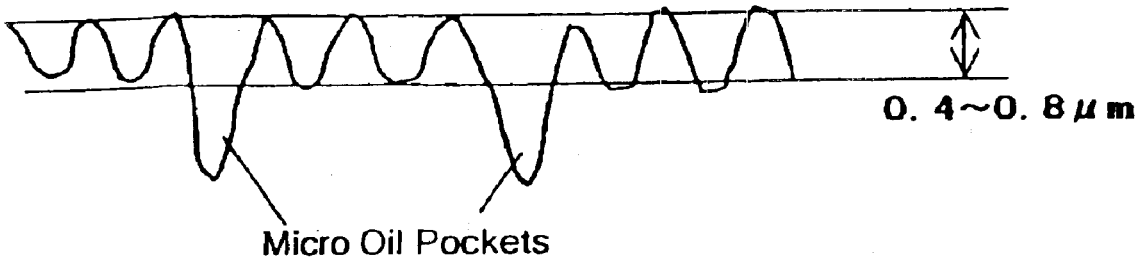
FIG. 2 is a section curve representing the roughness of a super-finish surface with micro oil pockets.
Figure 3:
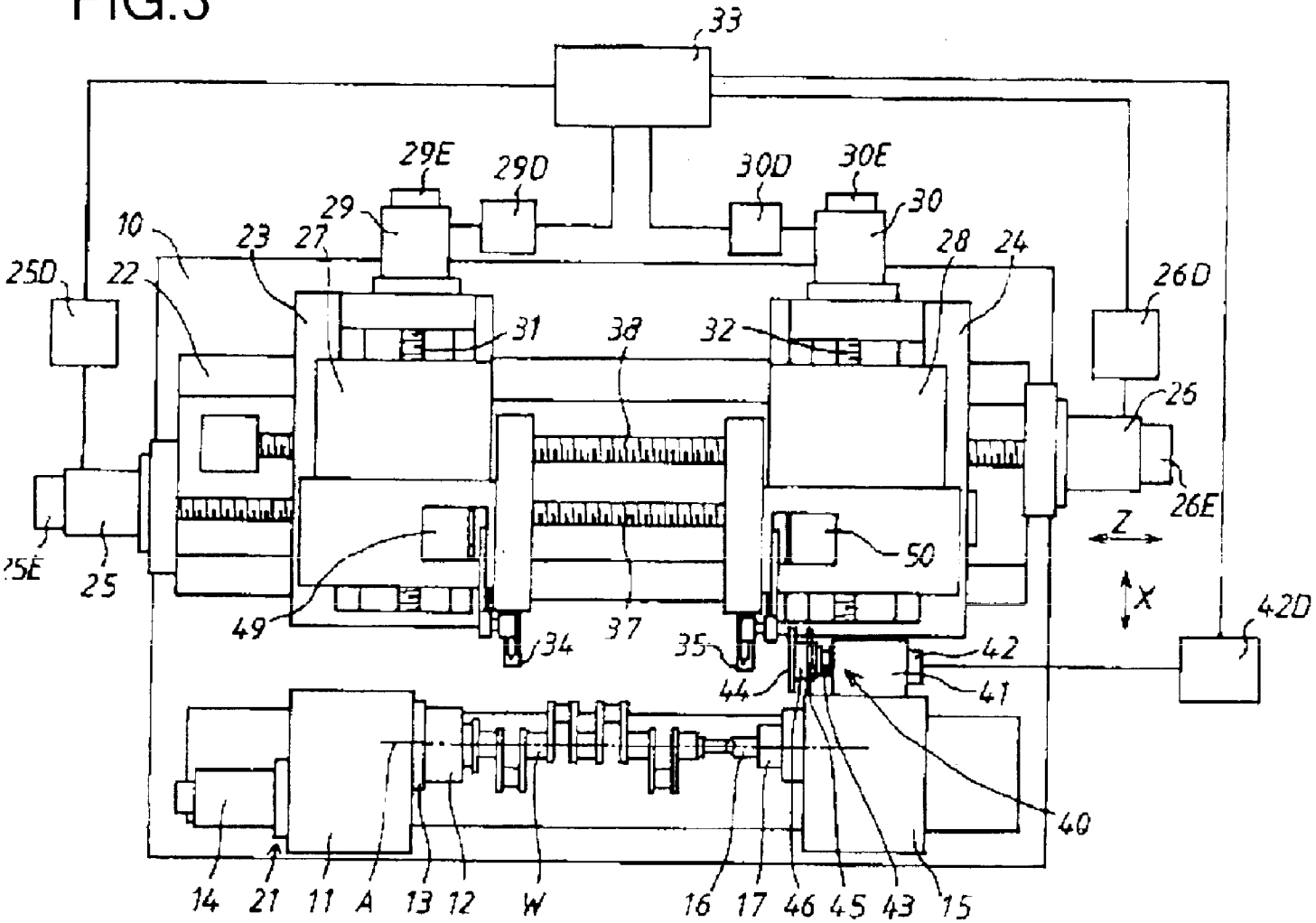
FIG. 3 is a plan view of a grinding machine for practicing a method of grinding a workpiece surface to a super-finish surface with micro oil pockets according to the present invention.

A grinding machine for grinding workpieces surfaces to super-finish surfaces with micro oil pockets according to the present invention will be described hereafter with reference to the accompanying drawings. Referring now to FIG. 3, a numeral 10 denotes a bed 10 of the machine, on which a work head 11 is fixed at a front-left position. A work spindle 13 having a chuck 12 mounted at its end is born in the work head 11 and is rotatable by a work spindle motor 14 about a rotational axis A. A numeral 15 denotes a tail stock, which is fixed at a front-right position on the bed 10 in face-to-face relation with the work head 11 and is adjustable toward and from the work head 11. A ram 17 having a center 16 fitted in its end is received in tail stock 15 for sliding movement on the aforementioned rotational axis A. The ram 17 is urged by means of a compression spring, not shown, toward the work head 11.

The workpiece W in the form of e.g., a crankshaft is grasped at its one end by the chuck 12 and is carried with the center 16 being fitted in a center hole formed at the other end. As the ram 17 is urged by means of the spring toward the work head 11, the workpiece W is supported by the chuck 12 and the center 16 and is rotated by the work spindle motor 14 about the rotational axis A.

At the rearward position on the bed 10 away from the work head 11 and the tail stock 15, there are provided guide rails 22 which extend in a Z-axis direction parallel with the rotational axis A. The guide rails 22 slidably carry and guide thereon a first table 23 at left side and a second table 24 at right side. These tables 23, 24 are independently movable in the Z-axis direction by first and second Z-axis feed screw mechanisms 37,38 which are rotatable by first and second Z-axis servomotors 25,26, respectively. First and second wheel heads 27, 28 are respectively mounted on the first and second tables 23, 24 for sliding movements in an X-axis direction perpendicular to the rotational axis A. These heads 27, 28 are movable by first and second X-axis feed screw mechanisms 31, 32 driven by first and second X-axis servomotors 29, 30, in the X-axis direction independently of each other. The first and second Z-axis servomotors 25, 26 and the first and second X-axis servomotors 29, 30 are drivingly coupled to encoders 25E, 26E, 29E, 30E, so that the positions in the Z-axis direction of the first and second tables 23, 24 and the positions in the X-axis direction of the first and second wheel heads 27, 28 are detected to be fed back to a numerical controller 33. The first and second Z-axis servomotors 25, 26 and first and second X-axis servomotors 29, 30 are connected to the numerical controller 33 through driving circuits 25D, 26D, 29D, 30D so as to be rotationally controlled thereby. The servomotors and the driving circuits therefor, together with the first and second Z-axis feed screw mechanisms 37, 38 and the first and second X-axis feed screw mechanisms 31, 32, constitute feed devices for moving the first and second wheel heads 27, 28 independently of each other in the Z-axis direction parallel with the rotational axis A as well as in the X-axis direction perpendicular to the rotational axis A.

Wheel spindles driven by built-in motors about axes parallel with the Z-axis are supported in the first and second wheel heads 27, 28, respectively. These wheel spindles fixedly secures a finish grinding wheel 34 and a super-finish grinding wheel 35 at their inner ends which face with each other. The finish grinding wheel 34 is of the type that grinding substance segments of 5 to 10 millimeter thick are adhered bodily to the circumferential surface of a disk-like base member. The segments are composed of super abrasives such as diamonds, CBN or the like having the average grain size of #80 to #120 which are bonded by means of, e.g., vitrified bond. Similarly, the super-finish grinding wheel 35 is of the type that grinding substance segments of 5 to 10 millimeter thick are adhered bodily to the circumferential surface of a disk-like base member, wherein the segments are composed of super abrasives such as diamonds, CBN or the like having the average grain size of #400 to #600 bonded by means of, e.g., vitrified bond. Further, the finish grinding wheel 34 has a capability of attaining the surface roughness of R1 (for example, 4 to 1.5 $\mu$mRzISO) on the workpiece W machined at a finish grinding step referred to later. The super-finish grinding wheel 35 has a capability of attaining the surface roughness of R2 (for example, 0.8 to 0.4 $\mu$mRzISO).

The tail stock 15 which faces the second wheel head 28 carrying the super-finish grinding wheel 35 bodily secures a housing 41 of a truing device 40 at the side where the first and second wheel head 27, 28 are located. A truer spindle 43, driven by a driver comprising an invertor motor 42, is supported in the housing 41 in parallel with the rotational axis A. A finish wheel truer 44 and a super-finish wheel truer 45 are secured on one end of the truer spindle 43 with the later truer 45 located closer to the housing 41. The truers 44 and 45 are positioned by a spacer 46 interposed therebetween and are spaced by a distance which is wider than the width of a wider one of the finish and super-finish grinding wheels 34 and 35.

The finish wheel truer 44 is of the type for example that diamond abrasive having an average grain size of #40–#60 which is the half of the average grain size of the finish grinding wheel 34 is bonded with a metal bond on a circumferential surface of a disc-like base member. Similarly, the super-finish wheel truer 45 is of the type for example that diamond abrasive having an average grain size of #200–#300 which is the half of the average grain size of the super-finish grinding wheel 35 is bonded with a metal bond on a circumferential surface of a disc-like base member.

The invertor motor 42 for the truing device 40 is connected to the numerical controller 33 through a drive circuit 42D. The motor 42 changes the rotational speed of the truer spindle 43 in connection with the truing operation of the finish grinding wheel 34 with the finish wheel truer 44 and the truing operation of the super-finish grinding wheel 35 with the super-finish wheel truer 45, so that each grinding wheel can be trued with the associated truer rotating at an appropriate speed therefor. First and second sizing devices 49, 50 are mounted on the tops of the first and second wheel heads 27, 28 respectively. Each sizing device measures the diameter of a portion on a workpiece W which is under process with the finish grinding wheel 34 or the super-finish grinding wheel 35, to transmit the measured value to the numerical controller 33.

Figure 4:
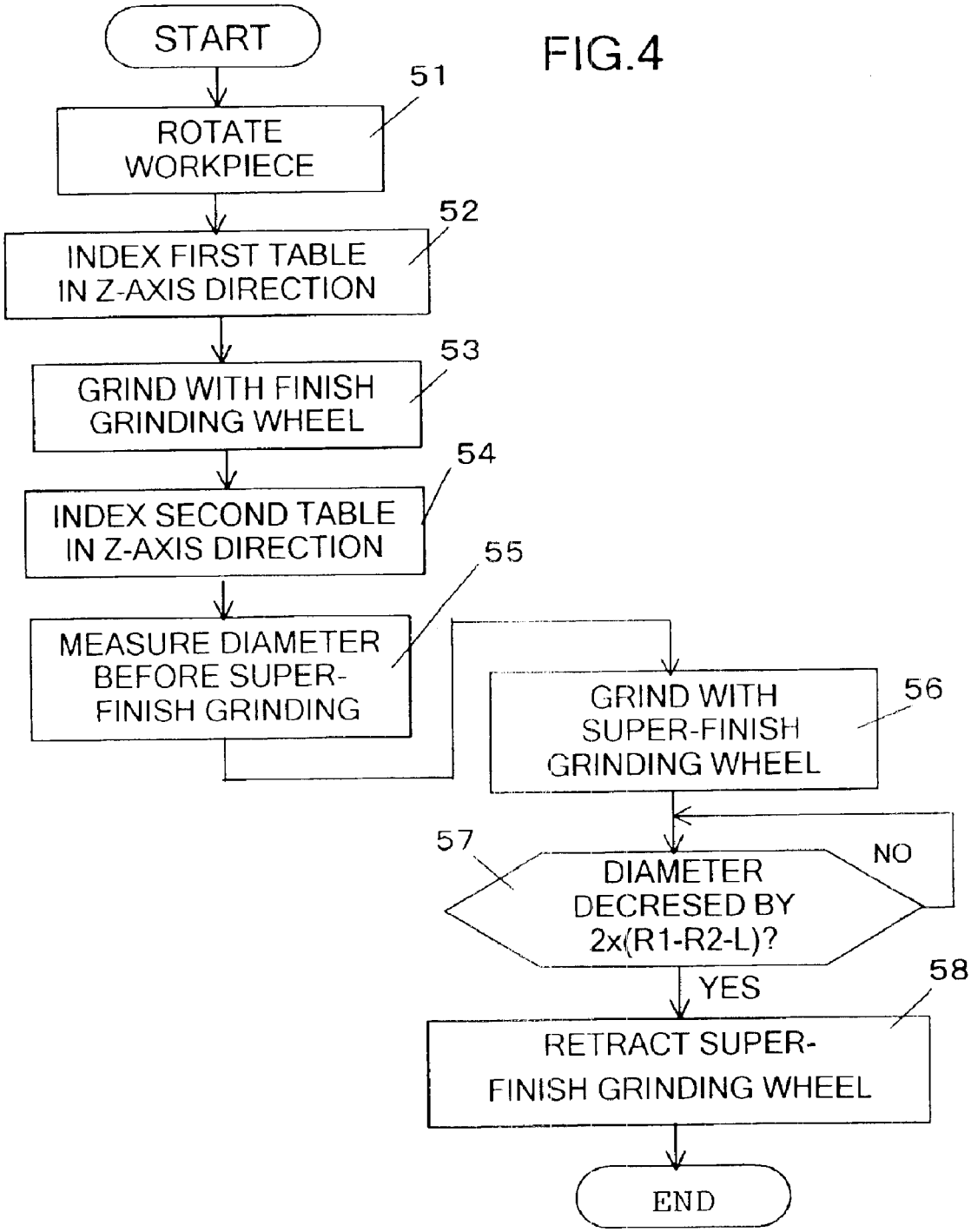
FIG. 4 is a program used in grinding the workpiece surface to the super-finish surface with the micro oil pockets.

A method of grinding a workpiece surface to a super-finish surface with micro oil pockets according to the present invention will be described hereinafter in connection with the operation of the aforementioned grinding machine. The embodiment described herein is directed to a method of forming micro oil pockets on journals of a crankshaft as the workpiece W which are cylindrical portions extending in axial alignment with the axis of the work spindle 13. When a start button is depressed with the workpiece W being supported with the chuck 12 and the center 16 between the work head 11 and the tail stock 15, the numerical controller 33 executes a program shown in FIG. 4 for grinding a workpiece surfaces to a super-finish surface with micro oil pockets.

More specifically, the work spindle motor 14 is driven to rotate the workpiece W bodily with the work spindle 13 (Step 51). Then, the first table 23 is indexed by the first Z-axis servomotor 25 in the Z-axis direction to make the finish grinding wheel 34 face a portion to be ground of the workpiece W (Step 52). Subsequently, the first X-axis servomotor 29 is driven by the command from the numerical controller 33, whereby in accordance with a finish grinding cycle, the first wheel head 27 is advanced from a retracted position at a rapid feed rate. The feed rate of the wheel head 27 is changed to a rough grinding feed rate right before the finish grinding wheel 34 comes into contact with the workpiece W, and the rough grinding of the portion begins. In the course of the rough grinding, a measuring head of the sizing device 49 is advanced and brings its probe into engagement with the portion under process to measure the diameter of the workpiece portion. When it is detected by the sizing device 49 that the diameter of the workpiece portion reaches a first size which is a target value for the rough grinding, the numerical controller 33 changes the rotational speed of the fist X-axis servomotor 29. This causes the first wheel head 27 to further advance at a fine grinding feed rate, whereby the workpiece portion is then brought into a fine grinding with the finish grinding wheel 34. When the sizing device 49 detects that the diameter of the workpiece portion has reached a second size as a target value for the fine grinding, the rotation of the first X-axis servomotor 29 is discontinued, and this causes the finish grinding wheel 34 to stop for a short period of time, whereby the workpiece portion is brought into a spark-out grinding prior to the subsequent rapid retraction of the first wheel head 27.

Figure 5:
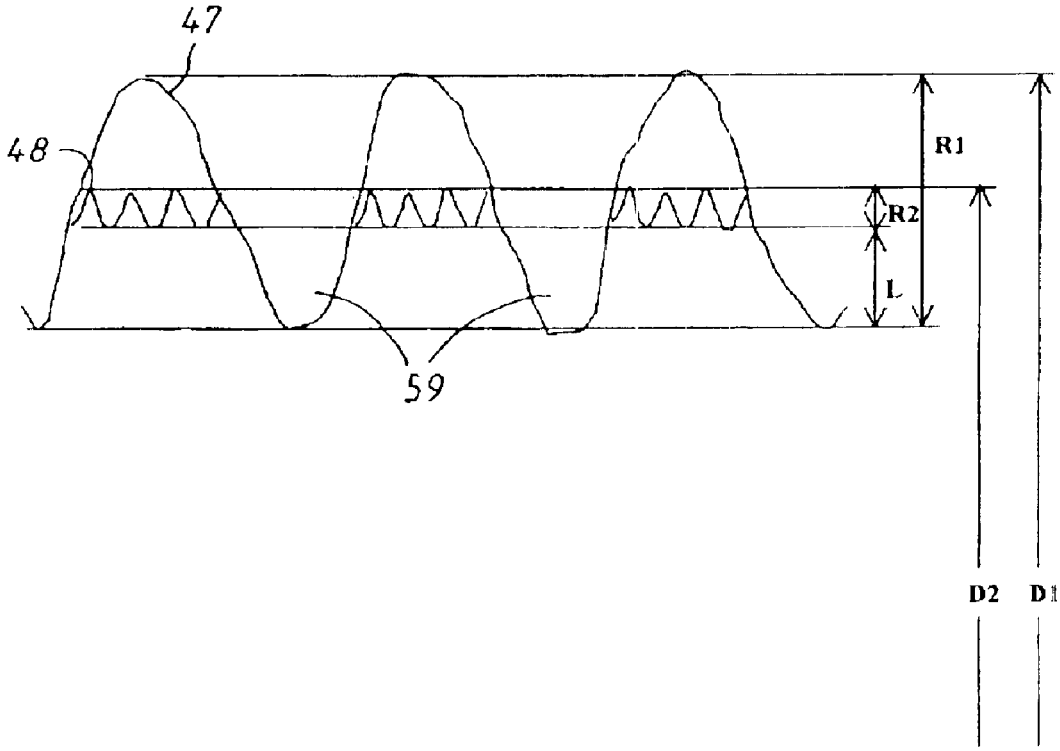
FIG. 5 is an explanatory view representing the relations among workpiece diameters D1, D2, surface roughnesses R1, R2 and the depth L of oil pockets respectively after finish grinding and super-finish grinding.

As illustrated in FIG. 5 in an exaggerated scale, the diameter D1 (mm) of the workpiece W is a target finish diameter to which it is to be ground with the aforementioned finish grinding wheel 34. Also in FIG. 5, the diameter to which the workpiece portion is to be ground in a super-finish grinding described later is illustrated as D2 (mm). In the embodiment described herein, the workpiece portion in the finish grinding step is ground to the target value D1 (Step 53) which is determined by the equation below.

$$D1=D2+2x(R1-R2-L)$$

Wherein:

D2: Target diameter (mm) in the super-finish grinding.

R1: Value of surface roughness ($\mu$mRzISO), e.g., average surface roughness of ten (10) points, which is calculated from the distance between peaks and bottoms of a section curve of the finish surface 47 finished with the finish grinding wheel 34.

R2: Value of surface roughness ($\mu$mRzISO) of a super-finish surface 48 to which the workpiece surface is to be ground with the super-finish grinding wheel 35 in the super-finish grinding.

L: Depth ($\mu$m) of the bottoms which are to be left as micro oil pockets 59 on the section curve of the finish surface 47 after the super-finish grinding.

To this end, the selection of abrasive grain and the setting of truing conditions are required so that the finish grinding wheel 34 and the super-finish grinding wheel 35 attain the surface roughness R1 in the finish grinding and the surface roughness R2 in the super-finish grinding, respectively. Typically, the surface roughness R1 is chosen to 4 to 1.5 $\mu$mRzISO for instance, while the surface roughness R2 is chosen to 0.8 to 0.4 $\mu$mRzISO for instance. Furthermore, the values R1 and R2 are chosen to form the micro oil pockets of a desired depth, for which the grain size of the grinding wheels 34, 35, the truing conditions therefor and so on are determined.

Upon completion of the finish grinding, the first table 23 is evacuated by the first Z-axis servomotor 25 to the leftmost position, and the second table 24 is indexed by the second Z-axis servomotor 26 to bring the super-finish grinding wheel 35 into alignment with the portion of the workpiece W on which the finish grinding was performed as described earlier (Step 54). Then, the second X-axis servomotor 30 is driven by the command from the numerical controller 33, and in accordance with a super-finish grinding cycle, the second wheel head 28 is advanced from the retracted end until the super-finish grinding wheel 35 reaches a position right before it comes into contact with the workpiece portion having been ground to the diameter D1, and is stopped at the position. Usually, the actual diameter D of the workpiece portion ground with the finish grinding wheel 34 does not coincide strictly with the target diameter D1 due to the difference in rigidity among the workpieces, the change in cutting ability of the finish grinding wheel 34 in the progress of finish grinding operation, and other factors. For this reason, as soon as the second wheel head 28 is stopped, a measuring head of the second sizing device 50 is advanced to bring a probe thereof into engagement with the workpiece portion on which the finish grinding was already effected, so that the actual diameter D of the workpiece portion before the super-finish grinding with the super-finish grinding wheel 35 is measured to be transmitted to the numerical controller 33 (Step 55).

By reference to the measured value D, the second wheel head 28 is thereafter advanced at an approach speed to a position where the super-finish grinding wheel 35 comes very close to the workpiece surface, and the wheel head 28 is advanced at a super-finish grinding feed rate. As a result, while the diameter of the workpiece portion is measured by the second sizing device 50, the super-finish grinding of the workpiece portion is carried out using the super-finish grinding wheel 35 (Step 56). During this grinding stage, the sizing device 50 monitors the change in diameter of the workpiece portion for the target size [D−2×(R1−R2−L)] to which the diameter D detected before this super-finish grinding is decreased by a super-finish grinding allowance [2×(R1−R2−L)]. When the target size is detected by the sizing device 50 (Step 57), the second wheel head 28 is retracted at the rapid feed rate to thereby complete the super-finish grinding of the workpiece portion (Step 58). In this manner, each of the portions of the workpiece W is ground to a super-finish surface having an infinite number of micro oil pockets 59 whose depth ranges from, e.g., one or several micron meter to one second micron meter. The foregoing operation is repetitively performed, whereby all the portions of the workpiece W are ground to have the micron oil pockets 59 thereon. Upon completion of all the workpiece portions, the rotation of the work spindle motor 14 is stopped, and the workpiece W is unloaded from the work head 14 and the tail stock 15.

Obviously, various modifications and variations of the present invention are possible. More specifically, for example, in the above-described method uses the sizing devices 49, 50. However, where the method is practiced on a higher precision machine tool whose resolution is one tenth or one hundredth of micron meter, such sizing devices are not essential and the method may be practiced without using such sizing devices.

Further, in the aforementioned embodiment, a super-finish grinding with the super-finish grinding wheel 35 is performed on the finish surface 47 to the extent that the bottoms of the section curve representing the surface roughness of the finish surface 47 are left to the depth L for the micro oil pockets 59. To secure the depth L for the micro oil pockets 59, the actual diameter D of the workpiece portion after the finish grinding with the finish grinding wheel 34 is measured by the second sizing device 50 in advance of the super-finish grinding with the super-finish grinding wheel 35, and the finish surface of the workpiece portion is super-finished with the super-finish grinding wheel 35 until it is detected by the second sizing device 50 that the diameter of the workpiece portion is decreased to the diameter [D1−2×(R1−R2−L)] which is smaller by the super-finish grinding allowance [2×(R1−R2−L)] than the diameter D measured prior to the super-finish grinding. In other words, the super-finish grinding allowance is determined based on the surface roughnesses R1, R2 attained by the finish and super-finish grindings and the depth L of the micro oil pockets 59 to be formed on the super-finish surface. Therefore, the depth L of the of the micro oil pockets 59 can be easily and precisely adjusted by varying the finish surface diameter D1 and the surface roughness of the finish surface 47 for example.

The method may be practiced in a simpler way than that described above. In a simpler way, the diameter of the workpiece surface during the super-finish grinding is monitored by the sizing device 50, and the super-finish grinding is performed until it is detected by the sizing device 50 that the diameter D detected prior to the super-finish grinding is decreased by the surface roughness R1 attained by the finish grinding. In this case, the relation R1=2(R2+L) is held. By decreasing the surface roughness R1 from the diameter D1 after the finish grinding, the half at the peak side of the surface roughness R1 is removed from the finish surface 47, so that the half at the bottom side of the surface roughness R1 is left on the super-finish surface 48 to form the micro oil pockets 59. That is, the depth L of the oil pockets 59 can be set to approximately the half of the surface roughness R1 attained by the finish grinding.

Figure 6:
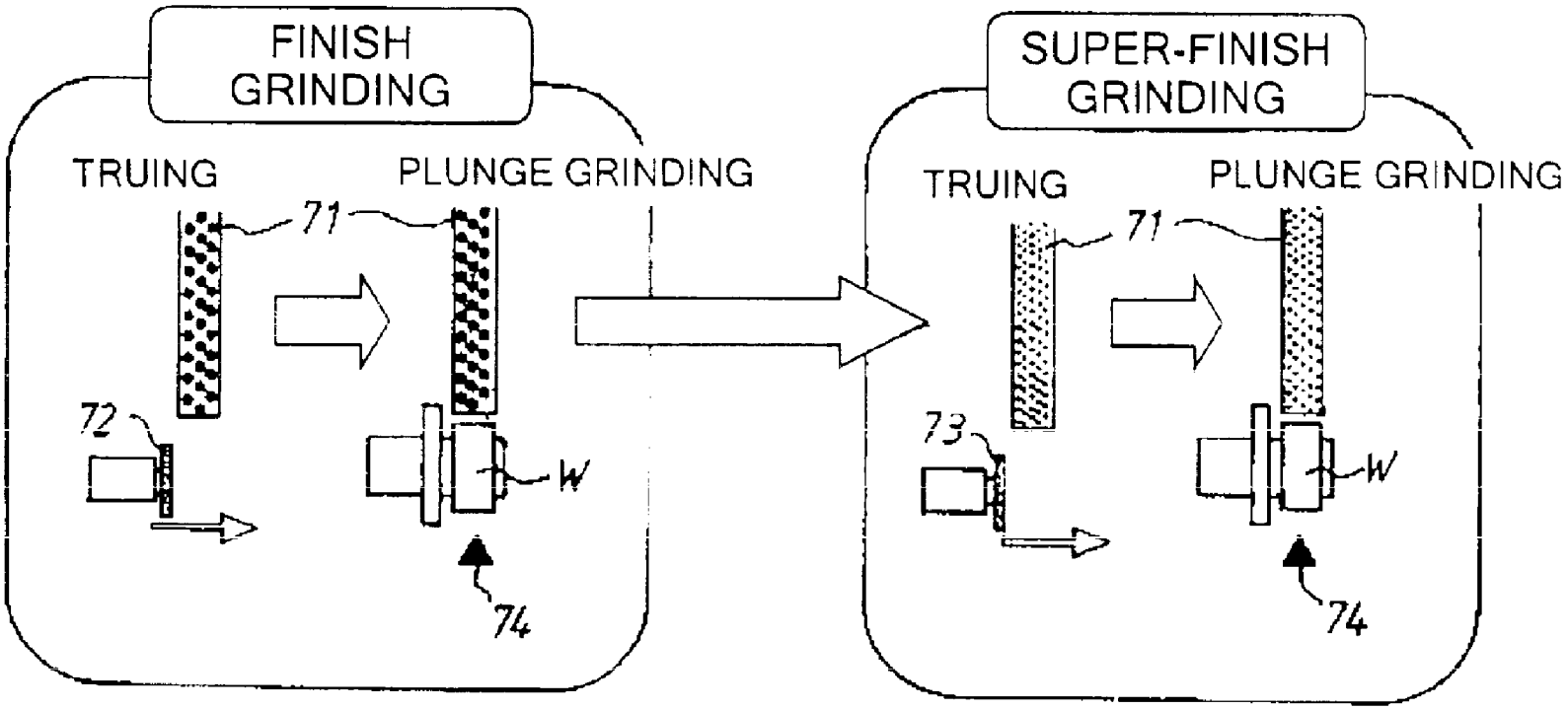
FIG. 6 is an explanatory view illustrating the process flow in the case where finish and super-finish grindings are carried out using a single grinding wheel.

In the foregoing embodiment, the finish grinding and the super-finish grinding are performed using the finish grinding wheel 34 and the super-finish grinding wheel 35, respectively. And, the average size of abrasive grains for the finish grinding wheel 34 is varied from that for the super-finish grinding wheel 35. However, the same effect can be achieved by using a single grinding wheel 71 as shown in FIG. 6. In this modified case, the finish wheel truer 72 and the super-finish wheel truer 73 may be given differences in average size of abrasive grains and truing conditions such as truing infeed depth and traverse feed rate relative to the grinding wheel. And, the grinding wheel 71 is trued with the finish wheel truer 72 for use in the finish grinding and with the super-finish truer 73 for use in the super-finish grinding. Therefore, the workpiece W is first finished with the grinding wheel 71 trued for the finish grinding and then, while being measured by the sizing device 47, is super-finished with the grinding wheel 71 trued for the super-finish grinding, the super-finish grinding being performed to the extent that the bottoms of the section curve indicating the surface roughness of the finish surface 47 are left to the depth L for the micro oil pockets 59.

Where two grinding wheels are used for the finish and super-finish grindings as described in the embodiment, they may be of the same or similar to each other in grinding capability. In this case, their effective grinding capabilities can be varied for the finish grinding as well as for the super-finish grinding by changing the truing conditions of the grinding wheels.

Moreover, by selecting and changing the truing conditions for the finish and super-finish grinding wheels, using two kinds of truers can be avoided, and a single kind of two truers or a single truer may be employed for truing the finish and super-finish grinding wheels.

Although the workpiece W in the aforementioned embodiment is exemplified taking the journals of a crankshaft, other kinds of workpieces such as cylindrical workpieces, crankpins of crankshafts, cams of camshafts or the like may be the workpiece W for the method and apparatus according to the present invention. Needless to say, the simultaneous control of the work spindle 13 and any of the wheel heads 27,28 is executed by the numerical controller 33 where eccentric portions such as cams or crankpins are ground.

Further modifications and variations of the present invention are possible in light of the above teachings. It is therefore to be understood that within the scope of the appended claims, the present invention may be practiced otherwise than described above.

What is claimed is:

1. A method of grinding a surface of a workpiece to a super-finish surface with micro oil pockets, comprising the steps of:

performing a finish grinding on a rotating workpiece with a finish grinding wheel to a predetermined size; and performing a super-finish grinding on the finish surface of the workpiece with a super-finish grinding wheel to the extent that bottoms of a section curve indicating the surface roughness of the finish surface are left to a depth for said micro oil pockets, wherein said finish grinding wheel and said super-finish grinding wheel comprise a single grinding wheel; wherein said single grinding wheel is trued to constitute said finish grinding wheel and is then used to effect said finish grinding on the workpiece; and wherein said single grinding wheel is trued to constitute said super-finish grinding wheel and is then used to effect said super-finish grinding on the workpiece.

2. A method of grinding a surface of a workpiece to a super-finish surface with micro oil pockets, comprising the steps of:

performing a finish grinding on a rotating workpiece with a finish grinding wheel to a predetermined size; and performing a super-finish grinding on the finish surface of the workpiece with a super-finish grinding wheel to the extent that bottoms of a section curve indicating the surface roughness of the finish surface are left to a depth for said micro oil pockets, wherein said finish grinding wheel and said super-finish grinding wheel comprise respective grinding wheels which are the same or similar to each other in grinding capability;

wherein one of said grinding wheels is trued to constitute said finish grinding wheel and is then used to effect said finish grinding on the workpiece; and wherein the other of said grinding wheels is trued to constitute said super-finish grinding wheel and is then used to effect said super-finish grinding on the workpiece.

3. An apparatus for grinding a surface of a workpiece to a super-finish surface with micro oil pockets, said apparatus comprising:

a bed;

a workpiece support device mounted on said bed for rotatably supporting said workpiece to be ground about a rotational axis;

first and second wheel heads mounted on said bed to be movable relative to each other in a direction parallel with said rotational axis and to be movable independently of each other toward and away from said workpiece;

a finish grinding wheel and a super-finish grinding wheel rotatably mounted respectively on said first and second wheel heads;

feed devices controllable by a numerical controller for respectively moving said first and second wheel heads independently of each other in a first direction parallel to said the rotational axis as well as in a second direction across said the rotational axis;

a sizing device for measuring the diameter of said workpiece to transmit the measured diameter to said numerical controller; and said numerical controller including means for grinding a surface of a workpiece to a super-finish surface with micro oil pockets, comprising the steps of performing a finish grinding on a rotating workpiece with a finish grinding wheel to a predetermined size; and performing a super-finish grinding on the finish surface of the workpiece with a super-finish grinding wheel to the extent that bottoms of a section curve indicating the surface roughness of the finish surface are left to a depth for said micro oil pockets, further comprising a truing device for truing said finish grinding wheel and said super-finish grinding wheel, wherein said truing device includes a pair of rotary truers rotatable on a common spindle for respectively truing said finish grinding wheel and said super-finish grinding wheel.

* * * * *